US010355407B2

(12) United States Patent
Nishi

(10) Patent No.: US 10,355,407 B2
(45) Date of Patent: Jul. 16, 2019

(54) CONNECTOR AND CONNECTOR ASSEMBLY WITH ROCKABLE LEVER TO ASSIST WITH MATING AND SEPARATING

(71) Applicant: Molex, LLC, Lisle, IL (US)

(72) Inventor: Norihiro Nishi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/899,207

(22) Filed: Feb. 19, 2018

(65) Prior Publication Data

US 2018/0261958 A1 Sep. 13, 2018

(30) Foreign Application Priority Data

Mar. 7, 2017 (JP) ..... 2017-042748

(51) Int. Cl.

| | |
|---|---|
| ***H01R 13/629*** | (2006.01) |
| ***H01R 13/635*** | (2006.01) |
| ***H01R 12/71*** | (2011.01) |
| ***H01R 13/627*** | (2006.01) |
| ***H01R 13/633*** | (2006.01) |
| *H01R 12/78* | (2011.01) |

(52) U.S. Cl.

CPC ..... *H01R 13/62938* (2013.01); *H01R 12/716* (2013.01); *H01R 13/6275* (2013.01); *H01R 13/62966* (2013.01); *H01R 13/635* (2013.01); *H01R 13/6335* (2013.01); *H01R 12/78* (2013.01)

(58) Field of Classification Search

CPC ..... H01R 13/62966; H01R 13/62933; H01R 13/6295; H01R 9/096; H01R 12/716; H01R 12/712; H01R 13/62938; H01R 13/6275; H01R 13/6335; H01R 13/635; H01R 12/78

USPC ..... 439/157, 65, 74, 160, 358, 372

See application file for complete search history.

(56) References Cited

U.S. PATENT DOCUMENTS

| | | | | |
|---|---|---|---|---|
| 4,070,081 A * | 1/1978 | Takahashi | ..... | H01R 13/629 439/372 |
| 5,308,254 A * | 5/1994 | Hatagishi | ..... | H01R 13/641 439/157 |
| 7,922,506 B1 * | 4/2011 | Harlan | ..... | H01R 12/7005 439/160 |

(Continued)

FOREIGN PATENT DOCUMENTS

| | | |
|---|---|---|
| JP | 01-129775 U | 9/1989 |
| JP | 06-168759 A | 6/1994 |

(Continued)

*Primary Examiner* — Travis S Chambers
(74) *Attorney, Agent, or Firm* — Molex, LLC

(57) ABSTRACT

A first connector has the rockable lever for engaging with a second connector. The lever has a working part, the operating part, and the regulating part. When a second connector is pressed downward toward the first connector, the working part is pressed by the second connector. As a result, the lever rocks and the regulating part regulates the upward movement of the second connector. At this time, the operating part moves upward. When an operator subsequently presses the operating part downward, the lever rocks in the opposite direction, and the regulating part allows the second connector to move upward. At this time, the first working part moves upward thus pressing the second connector upward.

18 Claims, 11 Drawing Sheets

(56) References Cited

U.S. PATENT DOCUMENTS

| | | | | |
|---|---|---|---|---|
| 2004/0023548 | A1* | 2/2004 | Noro | H01R 13/6271 439/353 |
| 2015/0087178 | A1* | 3/2015 | Ozeki | H01R 13/633 439/352 |

FOREIGN PATENT DOCUMENTS

| | | | |
|---|---|---|---|
| JP | 06-260245 | A | 9/1994 |
| JP | 4723528 | B2 | 7/2011 |

* cited by examiner

CONNECTOR AND CONNECTOR ASSEMBLY WITH ROCKABLE LEVER TO ASSIST WITH MATING AND SEPARATING

RELATED APPLICATIONS

This application claims priority to Japanese Application No. 2017-042748, filed Mar. 7, 2017, which is incorporated herein by reference in its entirety.

TECHNICAL FIELD

The present disclosure relates to a connector and a connector assembly.

BACKGROUND ART

Connectors configured to be mounted onto two circuit boards facing one another, and connect said boards, are disclosed in Patent Documents 1 and 2.

In Patent Document 1, a connector mounted on one circuit board has two locking arms for engaging a right end and a left end of a connector mounted on the other circuit board. The locking arms have hook parts on end parts thereof. The hook parts engage with the connector of the other circuit board. This makes it possible to enhance the connecting stability of the two connectors. The locking arms have operating parts on sides opposite the hook parts. The engagement between the hook parts and the connectors can be released and the two connectors can be separated by moving the operating parts left to right.

In Patent Document 2, a connector mounted on one circuit board has two locking fixtures having locking parts at end parts thereof. The two locking fixtures mate with holes formed on the left side and the right side of a connector mounted on the other circuit board, and the locking parts thereof engage with the edges of the holes. This makes it possible to enhance the connecting stability of the two connectors. The engagement between the other circuit board and the locking parts can be released and the two connectors can be separated by moving the locking parts left to right.

Patent Document 1: JP 06-168759 A

Patent Document 2: JP 06-260245 A

SUMMARY

While it is possible to improve connecting stability between two connectors using a conventional connector having locking arms and locking fixtures, it is preferable to make the work required to mate and separate the two connectors simpler.

The present disclosure proposes a connector and a connector assembly that are able to further simplify the work required to mate and separate connectors.

(1) An embodiment of a connector assembly proposed according to the present disclosure has a first connector and a second connector that mates to the first connector in a first direction. The first connector has a rockable lever for engaging with the second connector. The lever has: a working part, positioned in a first direction with respect to the second connector, which can move in the first direction and in a second direction, which is a direction opposite the first direction through the rocking of the lever; an operating part, positioned on an outside in a third direction intersecting the first direction and the second direction with respect to the second connector, able to move in the first and second directions through the rocking of the lever, positioned on a side opposite the working part sandwiching a rocking center of the lever, and that moves in a direction opposite that of the working part; and a regulating part able to move between a regulating position, positioned in the second direction with respect to part of the second connector, for regulating the movement of the second connector in the second direction, and an allowing position, positioned separated from said part of the second connector, for allowing the movement of the second connector in the second direction. The lever is able to move between a lever engaging position where the regulating part is provided in the regulating position and a lever releasing position where the regulating part is provided in the allowing position, and moves from the lever releasing position to the lever engaging position when the working part moves in the first direction and from the lever engaging position to the lever releasing position when the working part moves in the second direction. This embodiment has an advantage of making it possible to further simplify the work required to mate and separate a connector.

(2) In the connector assembly according to (1), the regulating part may be positioned between the working part and the operating part when viewing the first connector in the first direction, and the regulating part may be positioned farther in the second direction than a rocking center of the lever when viewing the first connector in a direction along a straight line passing through the rocking center of the lever. According to this embodiment, the regulating part approaches the second connector and is provided in the regulating position when the working part moves in the first direction. Conversely, the regulating part separates from the second connector and is positioned in the allowing position when the working part moves in the second direction, that is, when the operation part moves in the first direction.

(3) In the connector assembly according to (1) or (2), the regulating part is provided with an end part that protrudes in the first direction when in the lever engaging position, and the second connector is provided with a corner part that protrudes in the second direction so as to face the end part.

(4) In the connector assembly according to any one of (1) through (3), the lever may be provided in the lever releasing position under the lever's own weight in a state where the second connector is not mated with the first connector.

(5) In the connector assembly according to any one of (1) through (4), the working part extends toward the second connector from a base part positioned close to the rocking center of the lever, the regulating part extends toward the second connector from a base part positioned close to the rocking center of the lever, the working part and the regulating part are separated in the first and second directions, and the lever may have a reinforcing wall part by which the regulating part and the working part are connected.

(6) In the connector assembly according to (5), the lever has two reinforcing wall parts separated in a direction along a straight line passing through the rocking center of the lever as the aforementioned reinforcing wall, and the working part and the regulating part of the lever are formed between the two reinforcing wall parts.

(7) In the connector assembly according to any one of (1) through (6), the first connector has a housing having an outer peripheral wall part able to provide the second connector on an inside thereof, and the lever may be provided on an inside of the outer peripheral wall part and rockably supported by the outer peripheral wall part.

(8) In the connector assembly according to (7), at least part of the operating part may exceed the height of the outer peripheral wall part in the second direction when the regulating part is provided in the regulating position.

(9) In the connector assembly according to any one of (1) through (8), the first connector has a first lever and a second lever, mutually separated from one another, as the lever.

(10) An embodiment of a connector proposed according to the present disclosure is a connector having a rockable lever for engaging a counterpart connector to thus mate with the counterpart connector in a first direction. The lever has: a working part, positioned in a first direction with respect to the second connector, which can move in the first direction and in a direction opposite the first direction by rocking the lever; an operating part, positioned on an outside in a third direction intersecting the first direction and the second direction with respect to the second connector, able to move in the first and second directions by rocking the lever, positioned on a side opposite the working part sandwiching a rocking center of the lever, and that moves in a direction opposite that of the working part; a regulating position, positioned in the second direction with respect to part of the second connector, for regulating the movement of the second connector in the second direction; and a regulating part, positioned separated from said part of the second connector, able to move in a space with an allowing position for allowing the movement of the second connector in the second direction. The lever is able to move between a lever engaging position where the regulating part is provided in the regulating position and a lever releasing position where the regulating part is provided in the allowing position, and moves from the lever releasing position to the lever engaging position when the working part moves in the first direction and from the lever engaging position to the lever releasing position when the working part moves in the second direction. This embodiment has an advantage of making it possible to further simplify the work required to mate and separate a connector.

BRIEF DESCRIPTION OF THE DRAWINGS

FIG. 6A illustrates a state prior to the first connector and the second connector being mated together.

FIG. 6B illustrates a state where the first connector and the second connector are mated together.

FIG. 9A illustrates a lever in a lever releasing position.

FIG. 9B illustrates a lever in a lever engaging position.

DETAILED DESCRIPTION OF THE PREFERRED EMBODIMENTS

Figure 1:
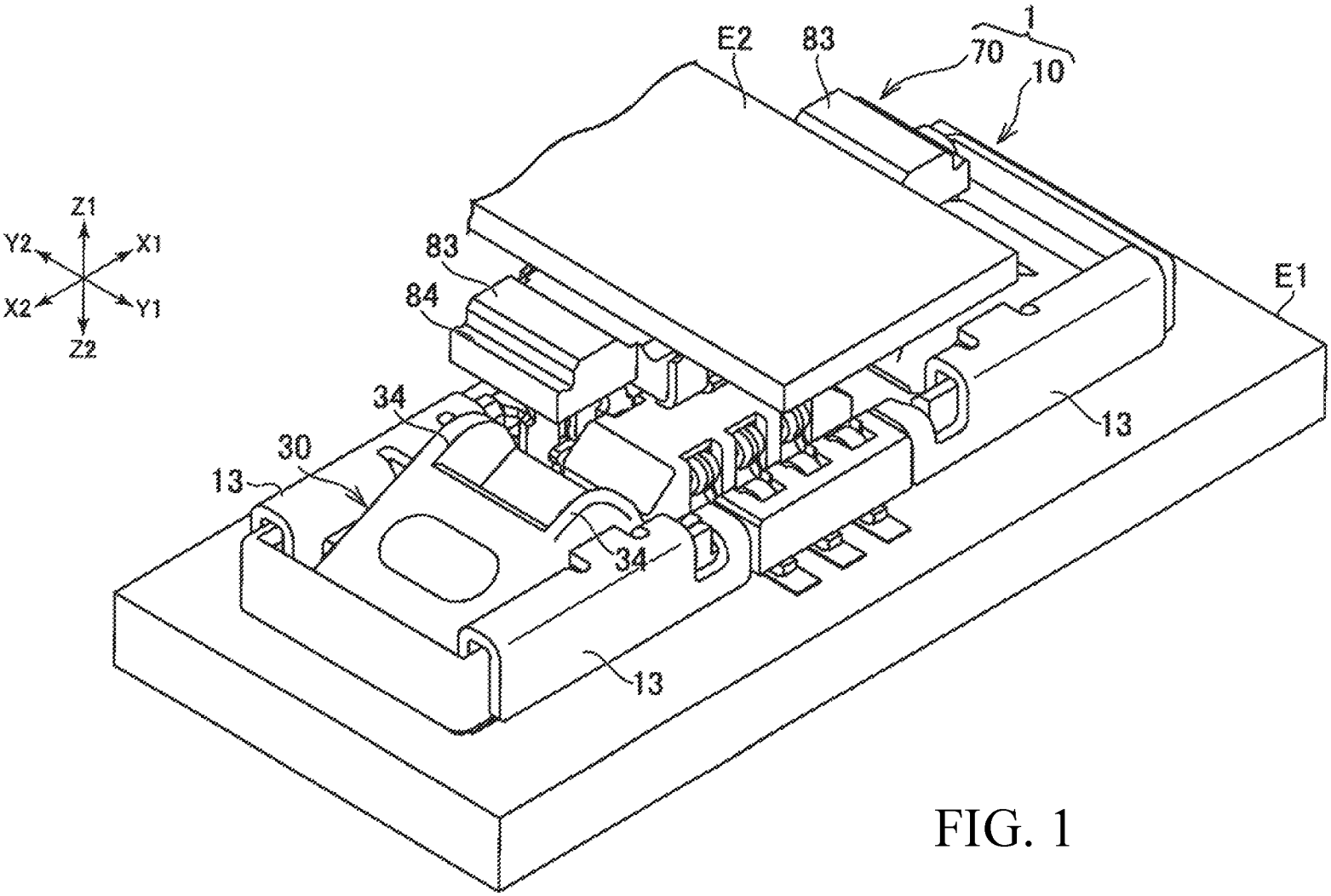
FIG. 1 is a perspective view illustrating an example of a connector assembly proposed according to the present disclosure.
Figure 2:
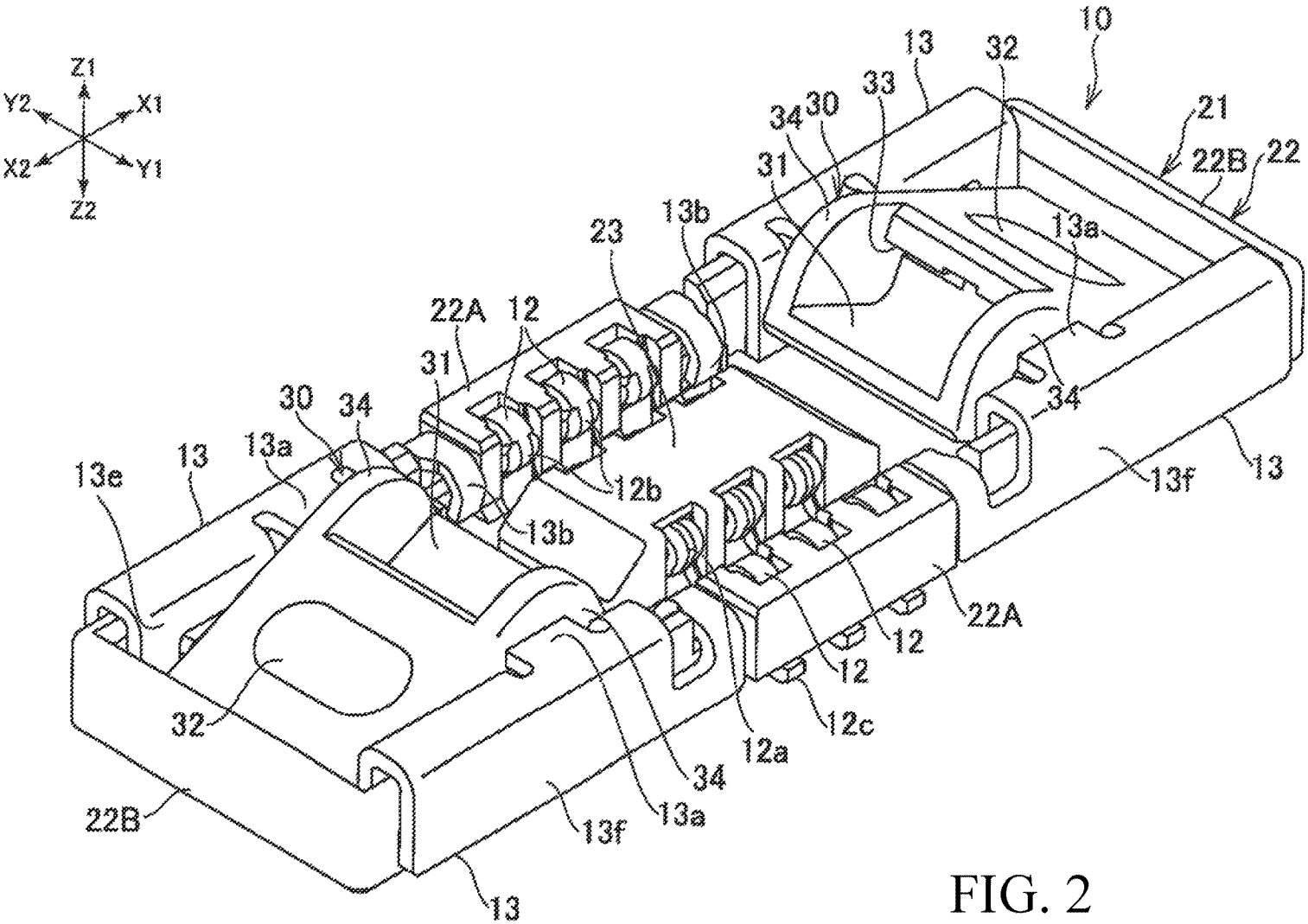
FIG. 2 is a perspective view of a first connector for configuring the connector assembly illustrated in FIG. 1.
Figure 3:
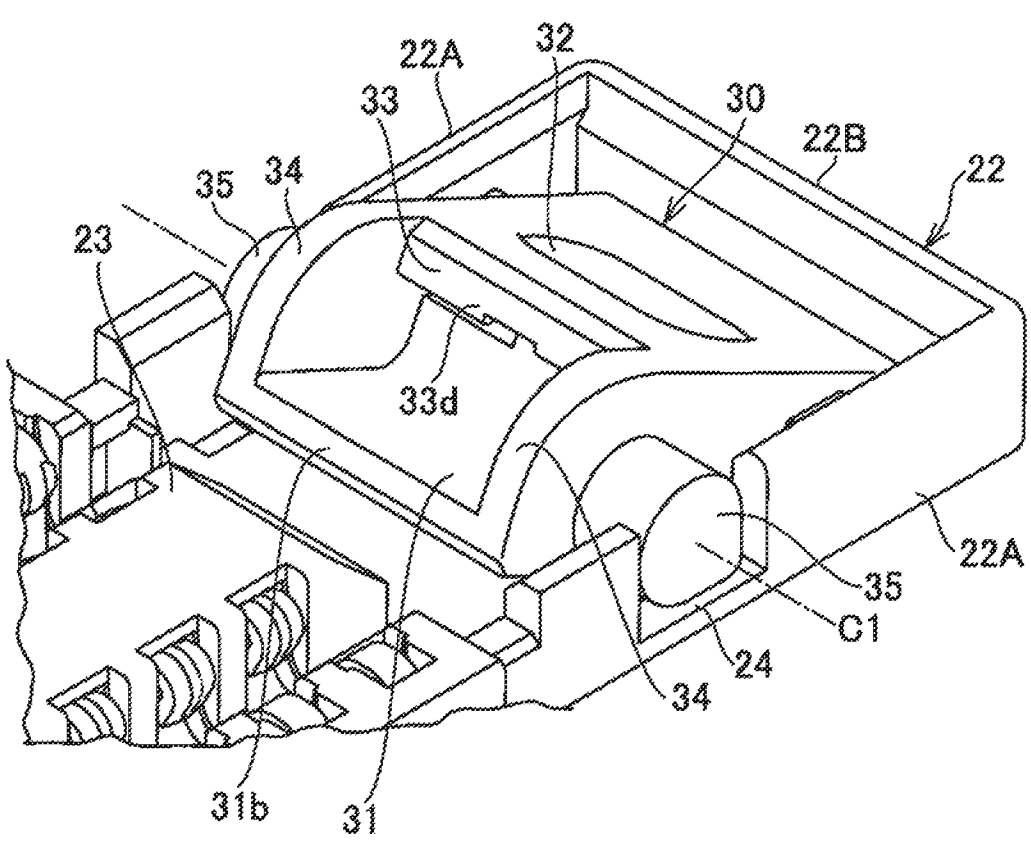
FIG. 3 is an enlarged perspective view of the first connector. A retainer is removed in this figure.
Figure 3:
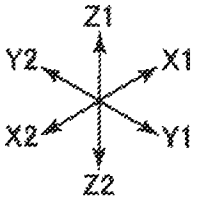
Figure 4:
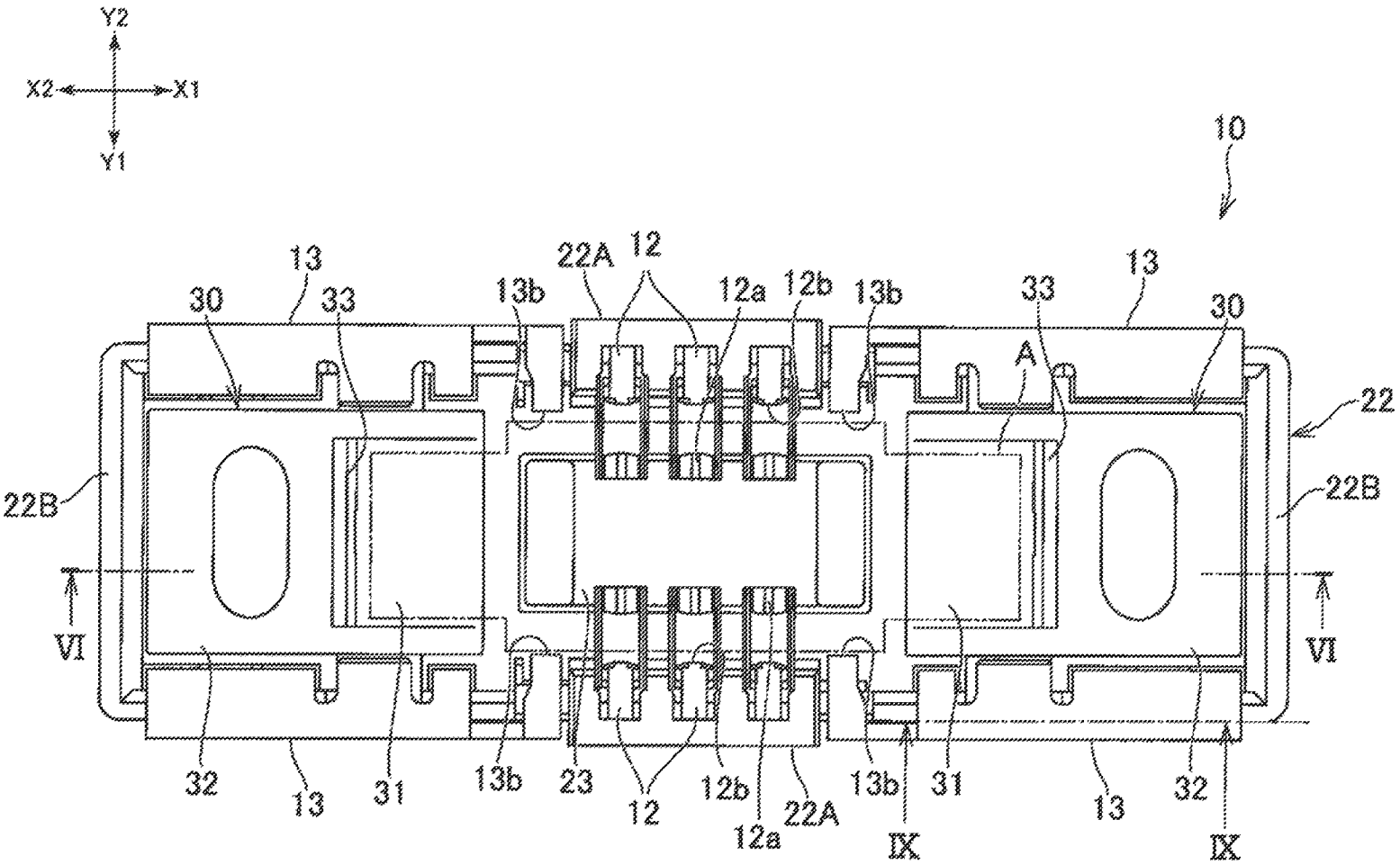
FIG. 4 is a plan view of the first connector.
Figure 5:
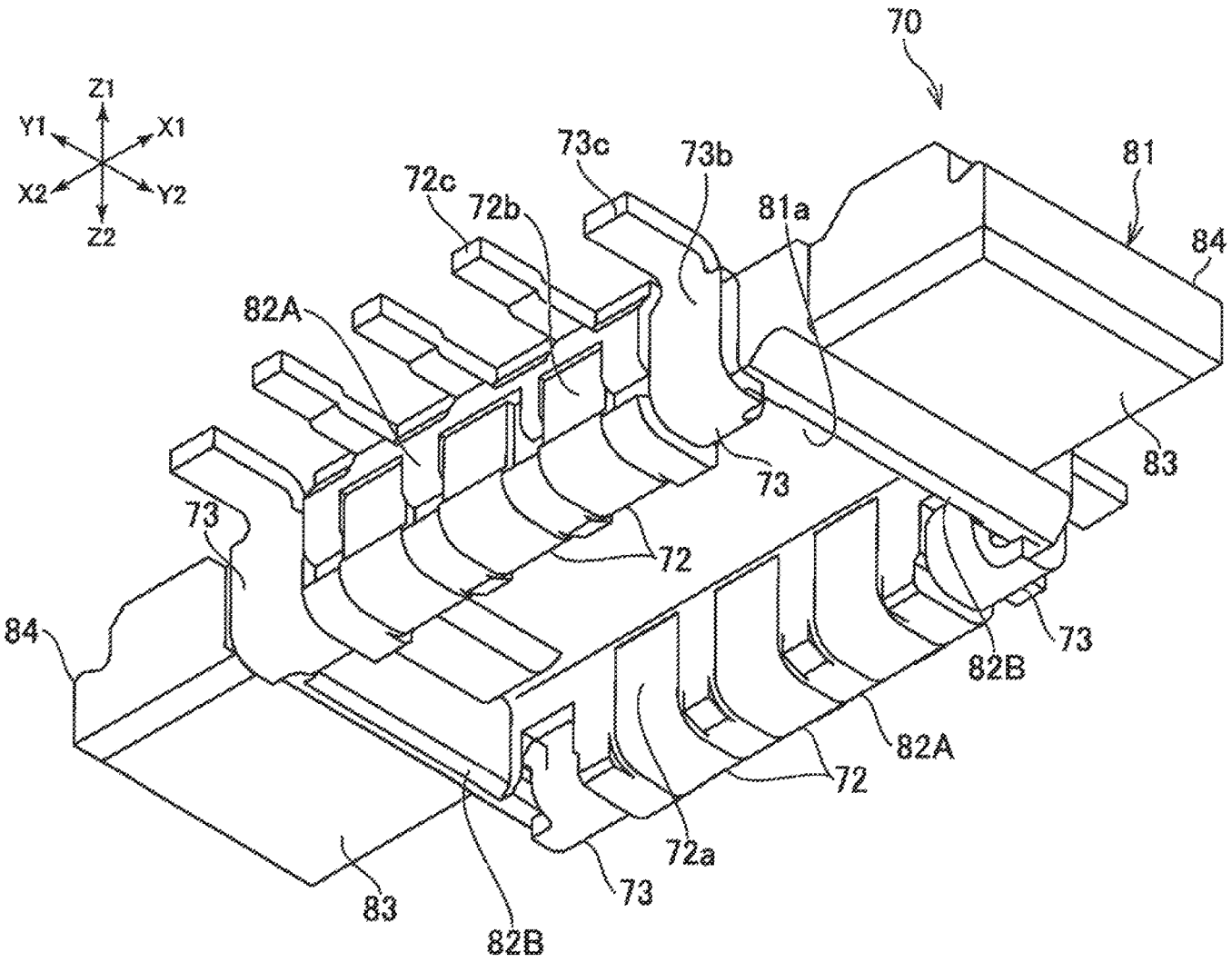
FIG. 5 is an enlarged perspective view of a second connector.
Figure 6A:
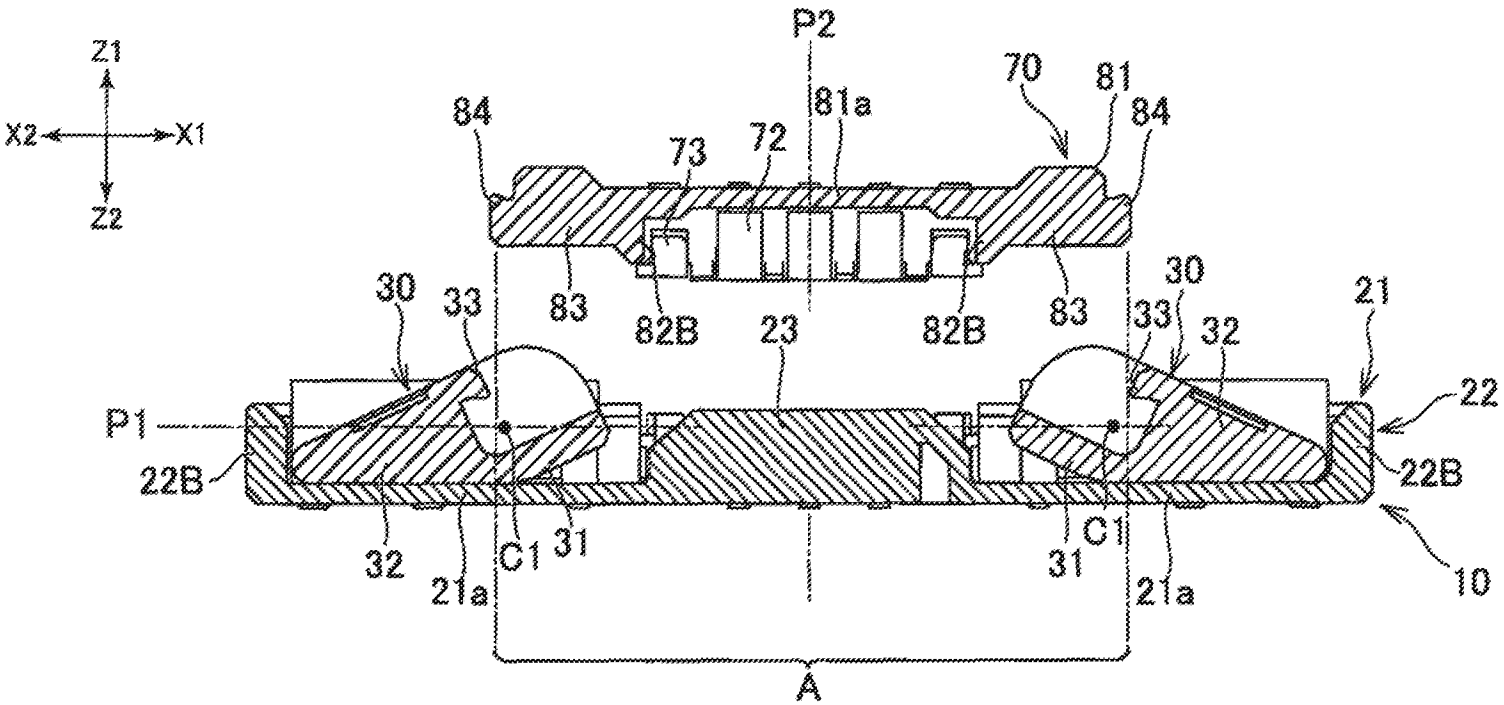
FIG. 6A is a cross-sectional view of the first and second connectors along the line VI-VI illustrated in FIG. 4.
Figure 6B:
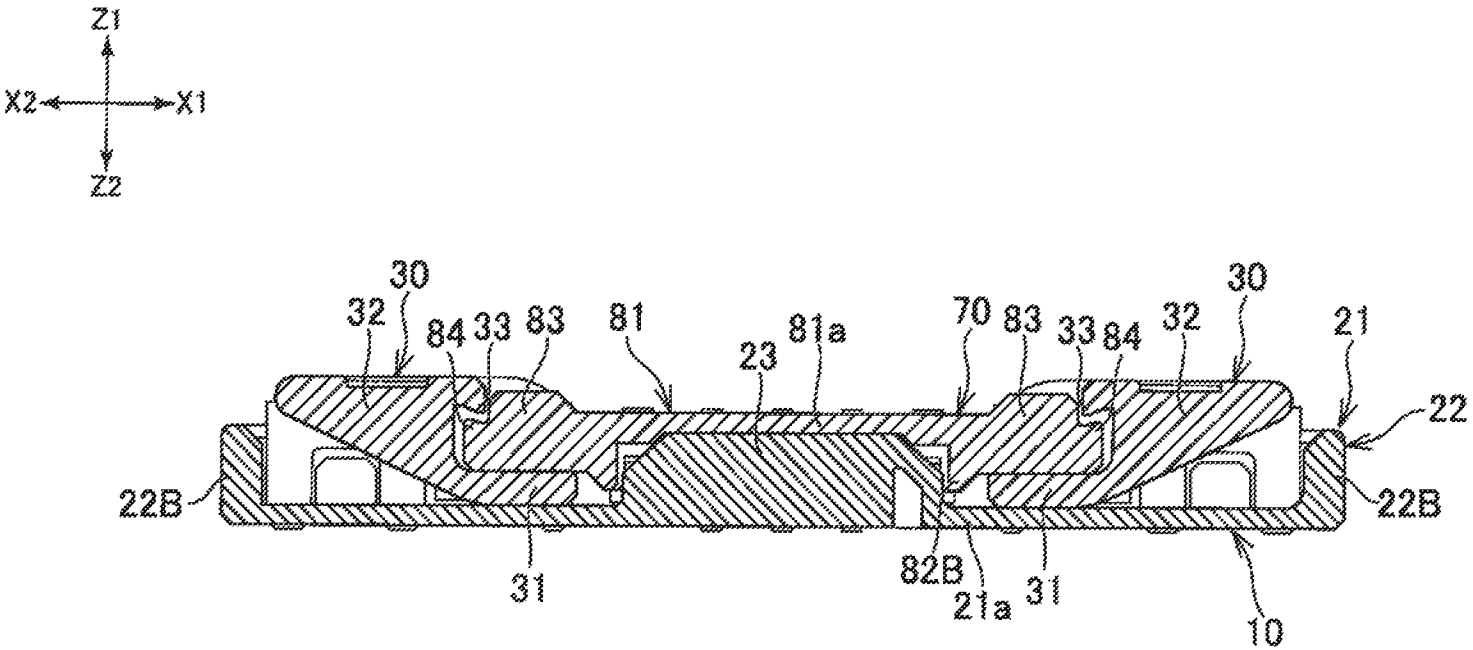
FIG. 6B is a cross-sectional view of the first and second connectors along the line VI-VI illustrated in FIG. 4.
Figure 7:
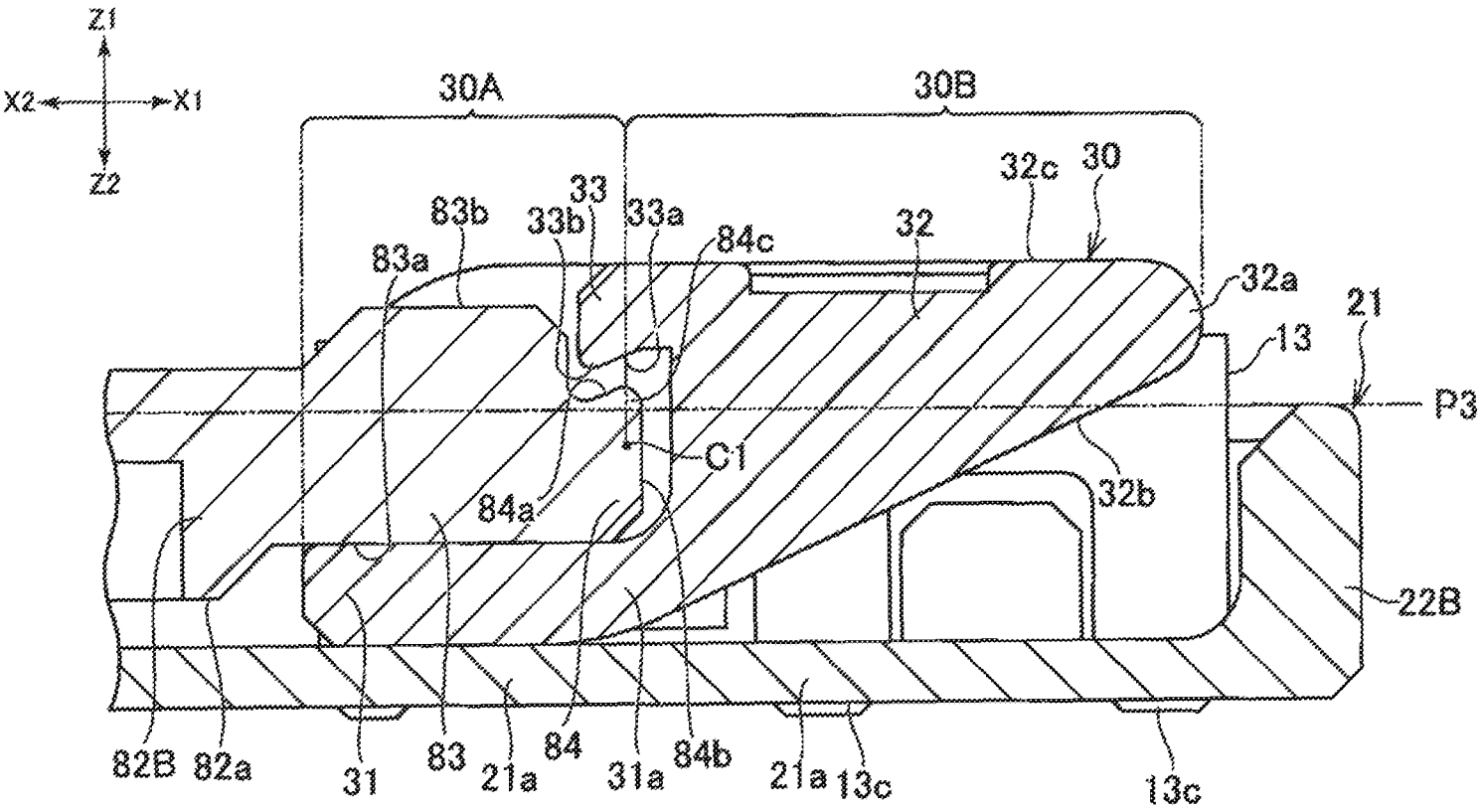
FIG. 7 is an enlarged view of FIG. 6B.
Figure 8:
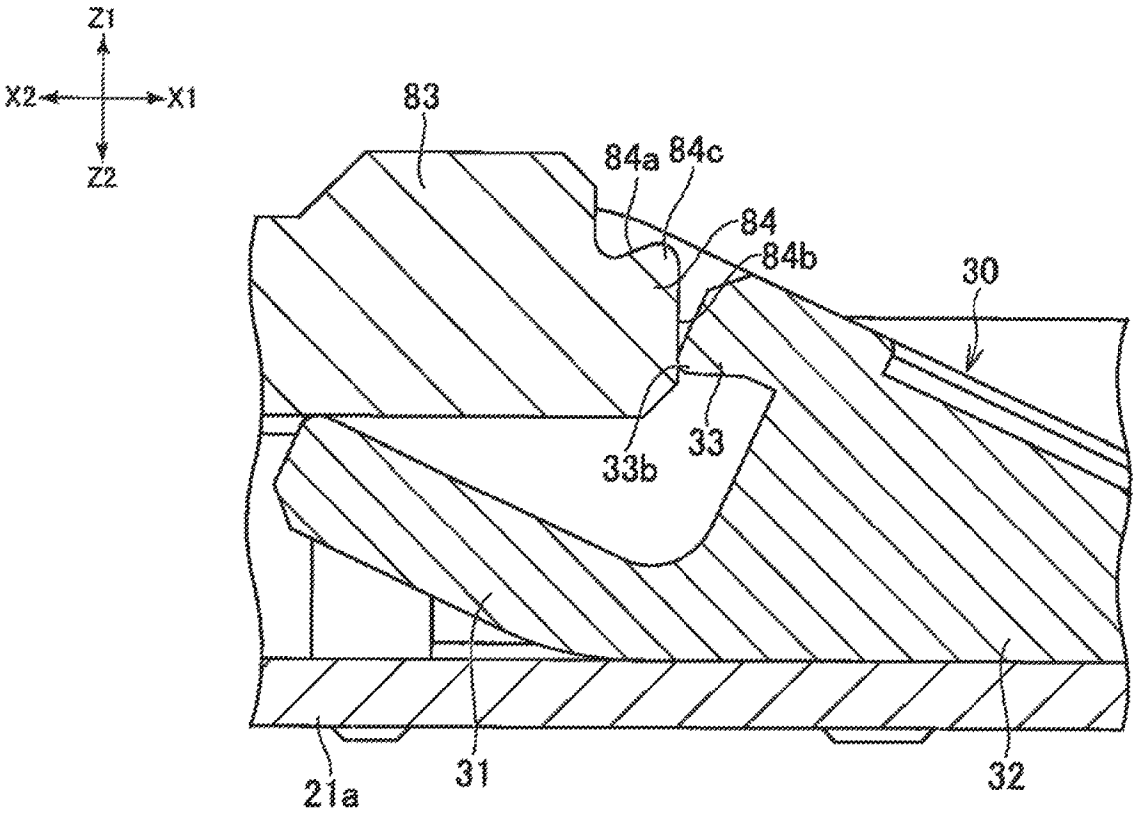
FIG. 8 is a cross sectional view illustrating a degree to which the first and second connectors mate with one another.
Figure 9A:
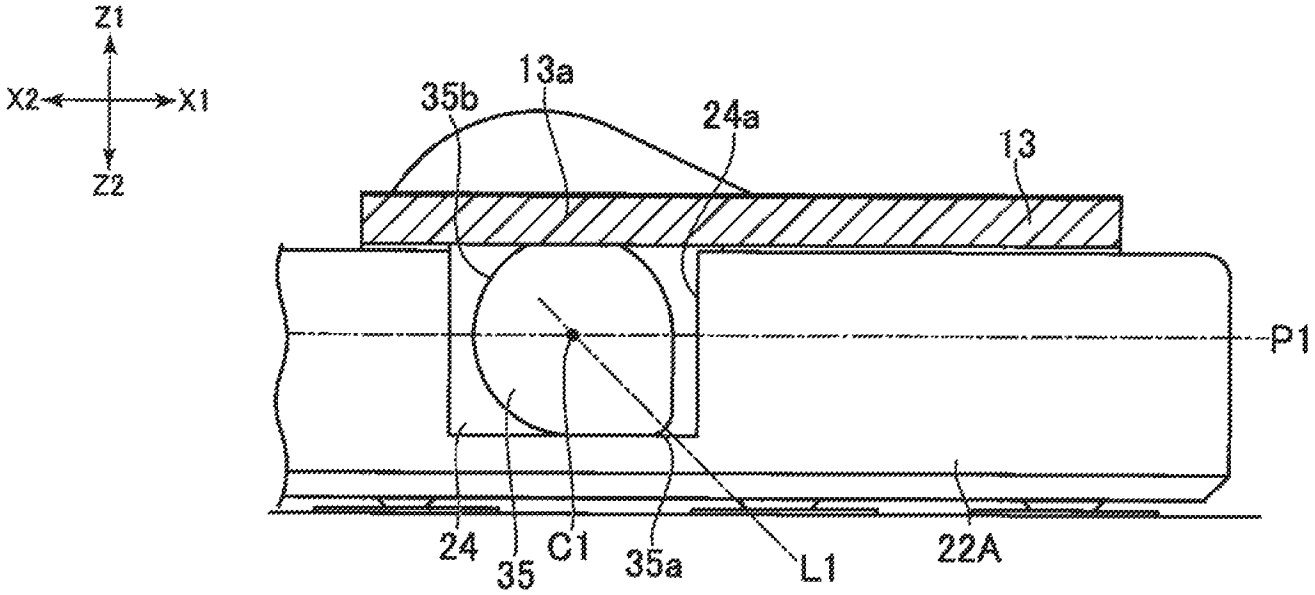
FIG. 9A is a cross-sectional view along the line IX-IX illustrated in FIG. 4.
Figure 9B:
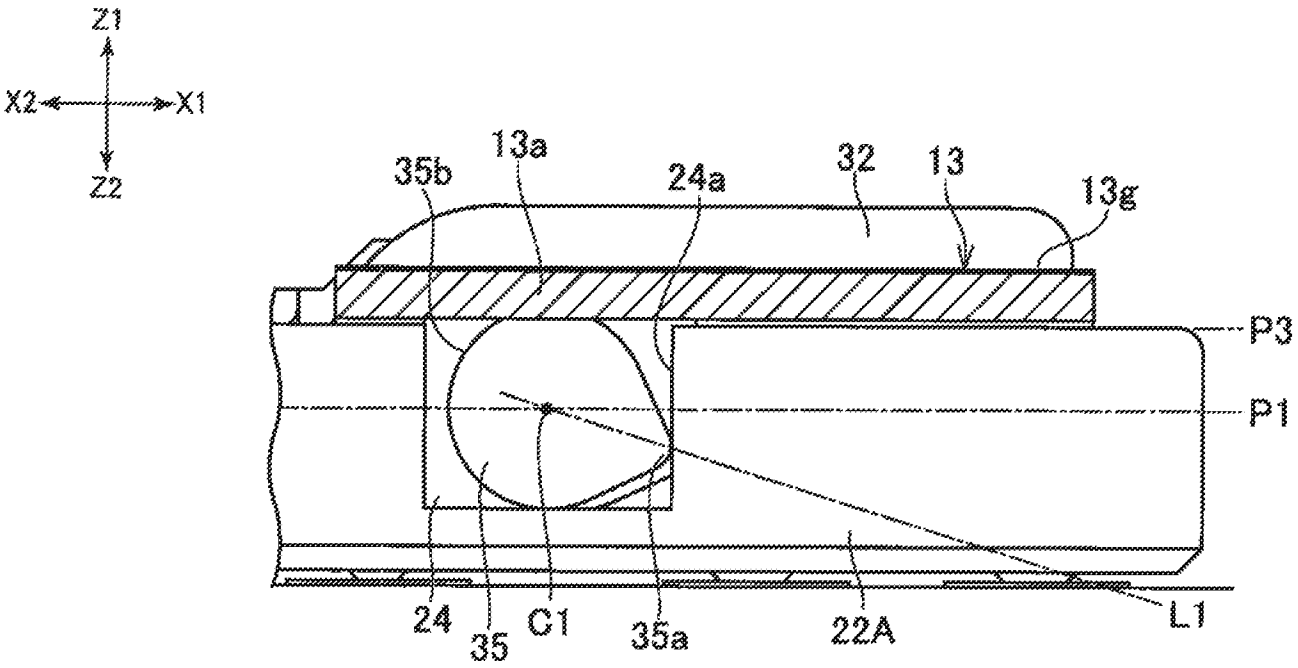
FIG. 9B is a cross-sectional view along the line IX-IX illustrated in FIG. 4.

Embodiments of a connector and a connector assembly according to the present disclosure are described below. FIG. 1 is a perspective view of a connector assembly 1 that is one example of the present embodiment. As illustrated in FIG. 1, the connector assembly 1 has a first connector 10 and a second connector 70. FIG. 2 is a perspective view of the first connector 10. FIG. 3 is an enlarged perspective view of the first connector 10, and a retainer 13 to be described later is removed in this figure. FIG. 4 is a plan view of the first connector 10. FIG. 5 is a perspective view of the second connector 70. FIG. 6A and FIG. 6B are cross-sectional views of the connectors 10 and 70 along the line VI-VI illustrated in FIG. 4. FIG. 6A illustrates a state prior to the first connector 10 and the second connector 70 being mated together, and FIG. 6B illustrates a state where the first connector 10 and the second connector 70 are mated together. FIG. 7 is an enlarged view of FIG. 6B. FIG. 8 is a cross-sectional view illustrating a degree to which the first connector 10 and the second connector 70 mate with one another, and a lever 30 to be described later is enlarged in this figure. FIG. 9A and FIG. 9B are cross-sectional views along the line IX-IX illustrated in FIG. 4. FIG. 9A illustrates the lever 30 in a lever releasing position, and FIG. 9B illustrates the lever 30 in a lever engaging position.

In the description given below, direction Z1 illustrated in FIG. 1 is referred to as upward, and direction Z2 is referred to as downward. Furthermore, a direction X1 and a direction X2 are referred to as a rightward direction and a leftward direction, respectively, while a direction Y1 and a direction Y2 are referred to as frontward and rearward, respectively. "Upward," "downward," "rightward direction," "leftward direction," "frontward," and "rearward," are directions for indicating relative positional relationships between portions configuring the connectors 10 and 70, and are not intended to specify the postures of the connectors 10 and 70 during use thereof.

The present embodiment describes the connectors 10 and 70 for connecting two mutually facing circuit boards (each "circuit board" includes a Flexible Printed Circuit (FPC) and a Flexible Flat Cable (FFC)). The variety of structures (for example, the structure of the lever 30) described in the present specification may be appropriately applied to a connector for connecting a circuit board and a plurality of cables, or to a connector for electrically connecting a plurality of cables to a plurality of cables.

Overview of the First Connector

As illustrated in FIG. 2, the first connector 10 has a first housing 21 for supporting a terminal 12. In the example of the first connector 10, the first housing 21 is configured so as to surround an area A in which the second connector 70 is provided (see FIG. 4), in other words, an area where the second connector 70 mates with the first connector 10 (hereinafter, area A is referred to as "mating area A"). The first housing 21 may have an outer peripheral wall part 22 surrounding the mating area A. The outer peripheral wall part 22 may be configured using, for example, two wall parts 22A extending in the leftward and rightward directions and mutually facing one another in the frontward and backward directions, and two end wall parts 22B mutually facing one another in the leftward and rightward directions. The end wall parts 22B connect end parts of the two wall parts 22A, and the outer peripheral wall part 22 is formed in a rectangle when seen in, for example, a plan view. A concave part is formed on the inside of the wall part 22A and the end wall part 22B. Additionally, the first housing 21 may have a bottom part 21*a* formed on the inside of the wall part 22A and the end wall part 22B. The first housing 21 may also have a center convex part 23 provided on the inside of the outer peripheral wall part 22. The center convex part 23 is formed so as to protrude upward from the bottom part 21*a* of the first housing 21. The first housing 21 is formed using, for example, a resin. The lever 30 is provided on the inside of the outer peripheral wall part 22 to suppress a separation between the first connector 10 and second connector 70. Two levers are positioned, one on each of the two end wall part 22B sides. The lever 30 will be described later.

As illustrated in FIG. 2, the first connector 10 has a plurality of the terminals 12 aligned in the leftward to rightward direction (hereinafter, terminal 12 is referred to as "first terminal"). Two rows of the plurality of the first terminals 12 are aligned in the example of the first connector 10. That is, a plurality of the first terminals 12 are provided between one of the wall parts 22A of the outer peripheral wall part 22 and the center convex part 23, while a plurality of the first terminals 12 are provided between the other of the wall parts 22A of the outer peripheral wall part 22 and the center convex part 23. The provision of the first terminal 12 is not limited to that in the example of the first connector 10. For example, the first connector may have a plurality of the terminals 12 aligned in three or four rows. In this case, the first connector 10 may have a plurality of the center convex parts 23 aligned in the frontward to backward direction. In another example, the number of rows of the terminals 12 may be one. Furthermore, the first connector 10 need not have the center convex part 23.

With the first connector 10, the first terminal 12 may be formed in a substantially U shape that opens upward. A groove may be formed in a side surface of the center convex part 23 and in an inner surface of the wall part 22A. Furthermore, the first terminal 12 may be provided in these grooves. The first terminal 12 may have an inner contact part 12*a* provided in the groove in the center convex part 23, and an outer contact part 12*b* provided in the groove in the wall part 22A. The first terminal 12 may also have a connecting part 12*c* provided on a downward side of the wall part 22A. In this case, a contact point with the second connector 70 has the inner and outer contact points 12*a* and 12*b* as contact points, which can enhance connecting reliability between the first connector 10 and the second connector 70. Furthermore, when the first connector 10 is used, the first connector 10 is provided in a circuit board E1 (see FIG. 1). Each of the connecting parts 12*c* of the first terminals 12 is connected to one of a plurality of conductor parts formed in the circuit board E1. Note that the shape of the first terminal 12, and a structure for attaching the first terminal 12 to the first housing 21 may change as appropriate. Furthermore, when the first connector 10 does not have the center convex part 23, the first terminal 12 need not have the inner contact part 12*a*.

Overview of Second Connector

As illustrated in FIG. 5, the second connector 70 has a second housing 81. In the example of the second connector, the second housing 81 has two wall parts 82A extending in the leftward and rightward directions and mutually facing one another in the frontward and backward directions, and two end wall parts 82B mutually facing one another in the leftward and rightward directions. The end wall parts 82B connect end parts of the two wall parts 82A, and the second housing 81 is formed in a rectangle when seen in, for example, a plan view. A concave part is formed on the insides of the wall parts 82A and 82B. The second housing 81 may also have a bottom part 81*a* formed on the insides of the wall parts 82A and 82B. In the example of the second connector 70, the second housing 81 has a second working part 83 extending outward in the leftward to rightward direction from the end wall part 82B. When the second connector 70 is mated to the first connector 10, the second working part 83 pushes down the lever 30 of the first connector 10. The lever 30 and the second working part 83 will be described later. Just like the first connector 10, the second housing 81 is formed using a resin. The shape of the second housing 81 is not limited to that of the example in FIG. 5, and thus may be appropriately varied to match the shape of the first connector 10.

As illustrated in FIG. 5, the second connector 70 has a plurality of the terminals 72 aligned in the leftward to rightward direction (hereinafter, terminal 72 is referred to as "second terminal"). The second terminal 72 may be connected to the wall part 82A. In greater detail, a plurality of second terminals 72 may be attached to each of two of the wall parts 82A, respectively. The second terminal 72 may be formed into, for example, a substantial U shape, and then attached to the wall part 82A so as to follow and outer surface and an inner surface of the wall part 82A. That is, the second terminal 72 may have an outer contact part 72*b* provided on an outer surface of the wall part 82A, and an inner contact part 72*a* provided on an inner surface of the wall part 82A. Furthermore, the second terminal 72 may have a connecting part 72*c* extending from an upward end of the outer contact part 72*b*. Furthermore, when the second connector 70 is used, the second connector 70 is provided in a circuit board E2 (see FIG. 1). Each of the connecting parts 72*c* of the first terminals 72 is connected to one of a plurality of conductor parts formed in the circuit board E2.

Mating of the Connectors

The second connector 70 and the first connector 10 mate in the upward to downward direction. In the example of the connectors 10 and 70, the second connector 70 is provided on the upward side of the first connector 10. In a state where the connectors 10 and 70 are mated, the second connector 70 is provided on the inside of the outer peripheral wall part 22 of the first housing 21 of the second connector 70. In the example of the connectors 10 and 70, the center convex part 23 of the first connector 10 mates with a concave part formed between the second connector 70 and the wall part 82A. At this time, the wall part 82A of the second connector 70 is provided between the center convex part 23 of the first connector 10 and the wall part 22A.

As was described above, the first terminal 12 of the first connector 10 may be formed in a substantially U shape that opens upward. In a state where the connectors 10 and 70 are mated, the second terminal 72 is provided on the inside of the first terminal 12, and is sandwiched in the frontward to rearward direction by the first terminal 12. For example, the outer contact part 72*b* of the second terminal 72 makes contact with the outer contact part 12*b* of the first terminal 12, and the inner contact part 72*a* of the second terminal 72 makes contact with the inner contact part 12*a* of the first terminal 12. The inner contact part 12*a* and the outer contact part 12*b* of the first terminal 12 may be elastically deformable so as to sandwich the second terminal 72.

Note that the provision of the second terminal and the shape of the second housing 81 are not limited to those of the example of the second connector 70, and thus may be appropriately varied to match the structure of the first connector 10. For example, when the center convex part 23 is not formed in the first connector 10, the second housing 81 need not have two facing wall parts 72A. In this case, the number of rows of the plurality of second terminals 72 may be one.

Lever

As illustrated in FIG. 3, the first connector 10 is rockable centered in the vicinity of a rocking center C1 (see FIG. 3), and may have the lever 30 for regulating a separation with the second connector 70. In the example of the first connector 10, the "rocking center C1" is a straight line orthogonal to the downward direction, in other words, an axial line extending in the frontward to backward direction. By rocking, the lever 30 can move between the lever engaging position (FIG. 6B) for engaging with the second connector 70 and the lever releasing position (FIG. 6A) for releasing the engagement with the second connector 70. As illustrated in FIG. 2, in the example of the first connector 10, two of the levers 30 are provided on mutually opposite sides sandwiching the mating area A (see FIG. 4) where the second connector 70 is provided, that is, the lever 30 is provided, one on the left and one on the right side of the mating area A. The number of levers 30 is not limited to two, and may be one. In this case, the first housing 21 of the first connector 10 may have a portion for engaging with the second connector 70 in a position on a side opposite the lever 30.

In the example of the first connector 10, the lever 30 has a working part 31 (hereinafter the working part is referred to as "first working part 31"), an operating part 32, and a regulating part 33. The levers 30 are integrally formed using, for example, a resin. In another example, the lever 30 may be configured by a plurality of parts each of which has been integrally formed using a resin. In yet another example, the lever 30 may be formed using metal.

Working Part

As illustrated in FIG. 6A and FIG. 6B, the first working part 31 is able to move in the upward and downward direction through rocking of the lever 30. That is, the first working part 31 can move in the upward and downward direction axially centered on the rocking center C1 of the lever 30. As described above, the second connector 70 mates onto the upper side of the first connector 10. Accordingly, in the example of the connectors 10 and 70, "downward" is a mating direction (the "first direction" in the claims) of the second connector 70, while "upward" is a separating direction (the "second direction" in the claims) of the second connector 70. As illustrated in FIG. 6A, the first working part 31 is positioned in the mating area A where the second connector 70 is provided, and is positioned downward with respect to the second connector 70. The first working part 31 is positioned in the mating area A both when the lever 30 is positioned in the lever engaging position, and when the lever 30 is in the lever releasing position. Accordingly, as illustrated in FIG. 6B, the first working part 31 is pressed by the second connector 70 when the second connector 70 mates with the first connector 10, and thus moves downward. Therefore, the lever 30 moves from the lever releasing position (FIG. 6A) to the lever engaging position (FIG. 6B). Conversely, the first working part 31 moves upward thus pressing the second connector 70 upward when the second connector 70 separates from the first connector 10. At this time, the lever 30 moves from the lever engaging position (FIG. 6B) to the lever releasing position (FIG. 6A). Note that part of the first working part 31 may be positioned outside the mating area A.

As was described above, the second connector 70 has the second working part 83 extending outward in the leftward and rightward direction from the end wall part 82B. As illustrated in FIG. 6B, the first working part 31 of the lever 30 is pressed by the second working part 83 of the second connector 70, and thus moves downward. Furthermore, the first working part 31 presses the second working part 83 of the second connector 70 upward.

Operating Part

As illustrated in FIG. 6A and 6B, the operating part 32 is positioned outside the mating area A. That is, the operating part 32 is positioned outside thereof in the leftward to rightward direction with respect to the second connector 70. The operating part 32 can also move in the upward to downward direction due to the rocking of the lever 30. That is the operating part 32 can also move in the upward to downward direction axially centered on the rocking center C1 of the lever 30. In the example of the first connector 10, the operating part 32 is positioned on a side opposite the first working part 31 sandwiching the rocking center C1. Therefore, the operating part 32 and the first working part 31 move in mutually opposite directions. That is, when the first working part 31 moves downward, in other words, when the lever 30 moves from the lever releasing position (FIG. 6A) to the lever engaging position (FIG. 6B), the operating part 32 moves upward. Conversely, when the first working part 31 moves upward, that is, when the lever 30 moves from the lever engaging position (FIG. 6B) to the lever releasing position (FIG. 6A), the operating part 32 moves downward.

Regulating Part

A regulating part 33 is a part for regulating the upward movement of the second connector 70, that is, a separation between the first connector 10 and the second connector 70. Due to the rocking of the lever 30, the regulating part 33 can move between a regulating position (FIG. 6B) and an allowing position (FIG. 6A). When the regulating part 33 is in the "regulating position," the regulating part 33 is positioned upward with respect to a part (a "regulated part 84" formed in the second working part 83) of the second connector 70 to thus regulate the upward movement of the second connector 70. When the regulating part 33 is in the "allowing position," the regulating part 33 does not regulate the upward movement of the second connector 70, that is, the first connector 10 and the second connector 70 separate. When the lever 30 is in the lever engaging position (FIG. 6B), the regulating part 33 is positioned in the regulating position, and, when the lever 30 is in the lever releasing position (FIG. 6A), the regulating part 33 is positioned in the allowing position. When regulation of the movement of the second connector 70 is released by the regulating part 33, that is, when the regulating part 33 is not positioned upward of the second working part 83 of the second connector 70, as illustrated in FIG. 6A, the first connector 10 and the second connector 70 are allowed to separate. When the first working part 31 moves downward, the lever 30 moves from the lever releasing position to the lever engaging position, and the regulating part 33 moves from the allowing position to the regulating position centered on the rocking position C1. Conversely, when the first working part 31 moves upward, the lever 30 moves from the lever engaging position to the lever releasing position, and the regulating part 33 moves from the regulating position to the allowing position centered on the rocking position C1.

Thanks to the lever 30, the work required to mate and separate the connectors 10 and 70 can be done more simply than was possible conventionally. That is, when an operator presses the second connector 70 downward to the first connector 10, as illustrated in FIG. 6B, the first working part 31 is pressed downward by the second working part 83 of the second connector 70. As a result, the lever 30 rocks and the regulating part 33 acts upon the second connector 70. At this time, the operating part 32 moves upward. When the operator subsequently presses the operating part 32 downward, the regulating part 33 rocks thus releasing the action (regulation of the movement of the second connector 70)

between the regulating part 33 and the second connector 70. At this time, the first working part 31 moves upward thus pressing the second connector 70 upward. In other words, the operator can use forces going in the same direction to perform the work required to mate and separate the connectors 10 and 70, and can thus perform said work simply. Furthermore, because the second connector 70 is pressed upward by the first working part 31 as a result of the separating work, the second connector 70 can be lifted from the first connector 10 easily. Note that the operator can mate the second connector 70 to the first connector 10 by pressing the second connector 70 downward toward the first connector 10. Furthermore, the operator can separate the first connector 10 and the second connector 70 by pressing the operating part 32 downward. In cases where the operator performs connector mating and separating using a machine or a power tool, the structure of said machine or power tool may be simplified because the connector mating and separation can be performed using forces going in the same direction as described above.

When the first connector 10 connector is seen in a plan view, the regulating part 33 may be positioned between the first working part 31 and the operating part 32 (see FIG. 4). Furthermore, as illustrated in FIG. 6A and FIG. 6B, when the first connector 10 is viewed in a direction in which an axial line passes through the rocking center C1, the regulating part 33 may be positioned farther upward than the rocking center C1 of the lever 30. That is, the regulating part 33 may be positioned upward with respect to a horizontal plane P1 (see FIG. 6A) (the "horizontal plane P1" is a plane orthogonal with respect to the upward to downward direction and passing through the rocking center C1). According to this positioning of the regulating part 33, the regulating part 33 moves due to the rocking of the lever 30 in the leftward to rightward direction centered on the rocking center C1. When the lever 30 rocks so that the first working part 31 moves downward, the regulating part 33 moves from the allowing position toward the mating area A. Conversely, when the lever 30 rocks so that the first working part 31 moves upward, the regulating part 33 moves outside the mating area A, and is thus provided in the allowing position.

Regulated Part of Second Connector

As was described above, when the lever 30 is in the lever engaging position, the regulating part 33 is positioned upward with respect to a part of the second connector 70. In the example of the second connector 70, the second working part 83 of the second housing 81 has the regulated part 84, as illustrated in FIG. 7. The regulated part 84 is formed on an end part of the second working part 83. When the lever 30 is in the lever engaging position, the regulating part 33 is positioned upward from an upper surface of the regulated part 84. When the second connector 70 is mated to the first connector 10 and the lever 30 is in the lever engaging position, the regulated part 84 is provided between the regulating part 33 and the first working part 31 of the of the first connector 10, and the regulating part 33 is positioned upward from the regulated part 84. As a result, the separation of the second connector 70 from the first connector 10 is suppressed by the regulating part 33. Note that when the lever 30 is in the lever engaging position, a gap is formed between the regulating part 33 and the regulated part 84, as illustrated in FIG. 7. In place of the example in FIG. 7, the regulating part 33 and the regulated part 84 may be touching one another when the lever 30 is in the lever engaging position.

The structure of the regulated part 84 is not limited to that in the example of the second connector 70. For example, a concave part may be formed in an end part 84*b* of the second housing 81. Meanwhile, the regulating part 33 may be a convex part protruding toward the mating area A. Furthermore, the regulating part 33 of the first connector 10 may be mated to the second housing 81 in a state where the connectors 10 and 70 are mated together. Even in this case, the second housing 81 will have a part (a part farther on the lower side from the concave part to which the regulating part 33 mates) positioned farther downward than the regulating part 33, and thus the regulating part 33 can control the upward movement of the second connector 70.

As illustrated in FIG. 7, the regulating part 33 of the first connector 10 has a contact surface 33*a*. The regulated part 84 of the second connector 70 also has a contact surface 84*a*. The contact surfaces 33*a* and 84*a* face one other in the upward to downward direction, and abut one another when the second connector 70 moves upward. In the example of the connectors 10 and 70, the contact surfaces 33*a* and 84*a* are inclined surfaces extending obliquely downward toward a center in the leftward and rightward direction of the mating area A. Therefore, the contact surface 33*a* configures an end part 33*b* extending downward, and the contact surface 84*a* configures a corner part 84*c* protruding upward. Using these contact surfaces 33*a* and 84*a*, it is possible to keep the regulating part 33 of the lever 30 from moving toward the allowing position when, for example, an external force that causes the second connector 70 to move upward is applied. Unlike the example of the connectors 10 and 70, the contact surfaces 33*a* and 84*a* need not be inclined. That is, the contact surfaces 33*a* and 84*a* may be formed horizontally.

Maintaining Lever Position

The lever 30 makes contact with other parts due to the process of moving the lever between the lever engaging position and the lever releasing position, and the lever may have a part for receiving resistance to the movement of the lever 30. This makes it possible to regulate the movement of the lever 30 from the lever engaging position to the lever releasing position when the lever 30 is in the lever engaging position. Conversely, it also makes it possible to regulate the movement of the lever 30 from the lever releasing position to the lever engaging position when the lever 30 is in the lever releasing position. In the example of the first connector 10, as illustrated in FIG. 8, the process of moving the regulating part 33 between the regulating position and the allowing position causes the part to hit the second connector 70. Furthermore, the regulating part 33 creates resistance to the movement of the lever 30. Using this structure, the lever 30 can be moved freely before the second connector 70 is mated to the first connector 10 because no resistance to the movement of the lever is created, and thus it is easy to provide the lever 30 in the lever releasing position.

In the example of the connectors 10 and 70, as illustrated in FIG. 8, the process of mating the second connector 70 to the first connector 10 (that is, the process of moving from the lever releasing position to the lever engaging position) causes the end part 33*b* of the regulating part 33 to hit the end surface 84*b* of the regulated part 84, thus creating resistance to the rocking of the lever 30 (the "end surface 84*b*" is a surface facing the outside, that is, a surface facing the lever 30). Furthermore, when the second connector 70 is pressed further downward toward the first connector 10, the regulating part 33 and the regulated part 84 deform elastically, and the end part 33*b* of the regulating part 33 moves upward along the end surface 84*b* of the regulated part 84. Moreover, when the end part 33*b* of the regulating part 33 rides up over the corner part 84*c* of the regulated part 84, the regulating part 33 is provided in the regulating position (the corner part 84*c* is the corner between the contact surface 84*a* and the end surface 84*b*). That is, the lever 30 is provided in the lever engaging position.

Conversely, when the lever 30 is in the lever engaging position, the lever 30 begins to move toward the lever releasing position when the operating part 32 of the lever 30 is pressed downward. In that process, the contact surface 33*a* of the regulating part 33 makes contact with the corner part 84*c* of the regulated part 84, thus creating resistance to the rotation of the lever 30. When the operating part 32 is pressed further, the regulating part 33 and the regulated part 84 deform elastically. Moreover, when the end part 33*b* of the regulating part 33 rides up over the corner part 84*c* of the regulated part 84, the regulating part 33 is provided in the allowing position. That is, the lever 30 is provided in the lever releasing position.

Thus, in the example of the connectors 10 and 70, a force for elastically deforming the regulating part 33 and the regulated part 84 is temporarily needed to rock the lever 30 from the lever engaging position toward the lever releasing position, and to rock the lever 30 from the lever releasing position toward the lever engaging position. As a result, when the lever 30 is in the lever engaging position, the lever 30 can be kept from moving to the lever releasing position. Conversely, when the lever 30 is in the lever releasing position, the lever 30 can be kept from moving to the lever engaging position.

The structure for holding the position of the lever 30 in the lever engaging position or the lever releasing position is not limited to that in the example of the connectors 10 and 70. For example, the lever 30 may have a part that hits the first housing 21 due to the process for moving the lever between the lever releasing position and the lever engaging position. Furthermore, said part hitting the first housing 21 creates resistance to the movement of the lever 30. Moreover, the movement of the lever 30 may be allowed by said part deforming elastically. Additionally, in another example, a part other than the regulating part 33 may hit the second connector 70 due to the process of moving between the lever engaging position and the lever releasing position. This may create resistance to the movement of the lever 30.

Initial Position of Lever

As illustrated in FIG. 7, the lever 30 has an outer part 30A and an inner part 30B. The outer part 30A includes the operating part 32, and is a part positioned outside in the leftward and rightward direction with respect to the rocking center C1. The inner part 30B includes the first working part 31, and is a part positioned inside in the leftward and rightward direction with respect to the rocking center C1. In the example of the connector 10, momentum around the rocking center C1 caused by the weight of the outer part 30A may be larger than momentum around the rocking center C1 caused by the weight of the inner part 30B. According to this structure, as illustrated in FIG. 6A, the outer part 30A falls in a state where the second connector 70 is not mated to the first connector 10. As a result, the lever 30 is automatically provided in the lever releasing position under its own weight. As a result, no work is required to provide the lever 30 in the lever releasing position prior to mating the second connector 70 and the first connector 10 together.

As illustrated in FIG. 7, in the example of the first connector 10, the length of the outer part 30A in the leftward to rightward direction is longer than the length of the inner part 30B in the leftward to rightward direction. Furthermore, the thickness of the outer part 30A is greater than the thickness of the inner part 30B, in other words, the thickness of the first working part 31. Therefore, the momentum created by the outer part 30A is larger than the momentum created by the inner part 30B. In the example of the first connector 10, the thickness of the outer part 30A (in other words, the thickness of the operating part 32) becomes thinner approaching an end part (the end part 32*a* of the operating part 32) thereof. The structure of the lever 30 is not limited to the example of the first connector 10. For example, the thickness of the outer part 30A may be constant in the leftward to rightward direction. Additionally, in another example, momentum around the rocking center C1 caused by the outer part 30A need not be larger than momentum around the rocking center C1 caused by the inner part 30B.

As illustrated in FIG. 7, in the example of the first connector 10, a lower surface 32*b* of the operating part 32 (lower surface of the outer part 30A) is an inclined surface extending obliquely upward toward the outside in the leftward and rightward direction. Therefore, a space for allowing the operating part 32 to move below the operating part 32 is formed when the lever 30 is in the lever engaging position. The shape of the operating part 32 may be varied as appropriate.

Working Part of Lever

As illustrated in FIG. 7, a base part 31*a* of the first working part 31 may be positioned farther downward than the rocking center C1 of the lever. Furthermore, the first working part 31 extends toward the second connector 70 from the base part 31*a*. That is, the first working part 31 may extend toward a vertical surface P2 (see FIG. 6A) passing through the center of the mating area A (the vertical surface P2 passes through the leftward and rightward center of the mating area A, and is a plane that is parallel to the upward to downward direction). When the lever 30 is in the lever releasing position, the first working part 31 extends inclined upward toward the vertical surface P2. Furthermore, a space for allowing the first working part 31 to move to the lower side of the first working part 31 may be formed. As illustrated in FIG. 7, when the lever 30 is in the lever engaging position, the first working part 31 may be provided along the bottom part 21*a* of the first housing 21. At this time, the first working part 31 may make contact with the bottom part 21*a*.

Operating Part of Second Connector

As was described above, the second housing 81 of the second connector 70 has the end wall part 82B and the second working part 83. As illustrated in FIG. 7, a lower surface 83*a* of the second working part 83 is positioned in a position that is higher than a lower end 82*a* of the end wall part 82B, and thus a space in which the first working part 31 is provided on a lower side of the lower surface 83*a* of the second working part 83 may be secured. An upper surface 83*b* of the second working part 83 may be positioned in a position that is higher than the contact surface 84*a* of the regulated part 84. Therefore, adequate second working part 83 thickness can be secured thus enhancing the rigidity of the second working part 83. The shape of the second working part 83 is not limited to that of the example of the second connector 70 and can be varied as appropriate.

Regulating Part of Lever

Just like the first working part 31, the regulating part 33 extends toward the second connector 70 from a base part thereof (see FIG. 7). In other words, the regulating part 33 may extend toward the vertical surface P2 (see FIG. 6A) passing through the center of the mating area A. A concave part may be formed between the regulating part 33 and the first working part 31. As illustrated in FIG. 6B, in a state where the connectors 10 and 70 are mated, the regulated part 84 of the second connector 70 is positioned in the concave part between the regulating part 33 and the first working part 31. In the example of the first connector 10, the first working part 31 and the regulating part 33 are formed substantially parallel. In the example of the first connector 10, the extending direction of the first working part 31 and the extending direction of the regulating part 33 may be inclined with respect to one another.

Reinforcing Wall Part

As illustrated in FIG. 3, the lever 30 may have a reinforcing wall part 34 to which the regulating part 33 and the first working part 31 are connected. The regulating part 33 and the first working part 31 are strengthened by the reinforcing wall part 34. For example, the wall can increase the rigidity of the first working part 31 with respect to force that the first working part 31 of the first connector 10 receives from the second connector 70, and can increase the rigidity of the regulating part 33 with respect to force that the regulating part 33 receives from the second connector 70.

In the example of the first connector 10, an edge part 33*d* (see FIG. 3) of the regulating part 33 and an edge part 31*b* (see FIG. 3) of the first working part 31 are connected to the reinforcing wall part 34 (the edge parts 33*d* and 31d are edges close to the center of the mating area A). The first working part 31 and the regulating part 33 are made even stronger because the edge part 31*b* of the first working part 31 and the edge part 33*d* of the regulating part 33 are supported by the reinforcing wall part 34. The shape of the reinforcing wall part 34 is not limited to that in the example of the first connector 10. For example, the edge part 31*b* of the first working part 31 and the edge part 33*d* of the regulating part 33 need not be supported by the reinforcing wall part 34.

As illustrated in FIG. 3, the lever 30 may have two of the reinforcing wall parts 34 separated in the frontward to rearward direction (the direction along a straight line passing through the rocking center C1) as the reinforcing wall part 34. The first working part 31 and the regulating part 33 are formed between the two reinforcing wall parts 34. The first working part 31 is a flat plate that continues from one of the reinforcing wall parts 34 to the other of the reinforcing wall parts 34. In the same way, the regulating part 33 also continues from one of the reinforcing wall parts 34 to the other of the reinforcing wall parts 34. The first working part 31 and the regulating part 33 are further strengthened by the shape of the lever 30. As was described above, the second housing 81 has the second working part 83 for pressing the first working part 31 of the lever 30. When the second connector 70 is mated to the first connector 10, the second working part 83 is provided between the two reinforcing wall parts 34. The shape of the lever 30 is not limited to that in the example of the first connector 10. For example, the reinforcing wall part 34 may be positioned in a center in the frontward to rearward direction of the lever 30, and may be a rib formed between the first working part 31 and the regulating part 33. Additionally, in another example, the lever 30 need not have the reinforcing wall part 34.

Provision and Support of the Lever

As was described above, the first housing 21 of the first connector 10 has the outer peripheral wall part 22 surrounding the mating area A. As illustrated in FIG. 2, the lever 30 may be provided on the inside of the outer peripheral wall part 22. Therefore, the outer peripheral wall part 22 can prevent an unexpected external force from acting upon the lever 30.

The lever 30 may be rockably supported by the outer peripheral wall part 22. In the example of the first connector 10, as illustrated in FIG. 3, the lever 30 has a supported part 35 on a side surface (a surface facing the wall part 22A of the first housing 21). The supported part 35 is positioned at the rotating center C1 of the lever 30. A support part 24 for rotatably supporting the supported part 35 is formed on the wall part 22A of the first housing 21. In the example of the first connector 10, the supported part 35 of the lever 30 is a convex part protruding from a side surface of the lever 30, and the support part 24 is a concave part to which the supported part 35 mates. In the example of the first connector 10, the support part 24 of the first housing 21 is a concave part that opens upward. The supported part 35 of the lever 30 is able to rock on the inside of the support part 24 of the first housing 21. The support structure of the lever 30 is not limited to the example of the first connector 10. For example, the support part 24 of the first housing 21 may be a convex part protruding toward the inside of the outer peripheral wall part 22. In this case, the supported part 35 of the lever 30 may be a concave part to which the support part 24 mates.

The supported part 35 of the lever 30 and the support part 24 of the first housing 21 may be formed so that the lever 30 is formed close to the mating area A when the lever 30 rotates from the lever releasing position to the lever engaging position. This allows the lever 30 and the second connector 70 to engage with one another more reliably.

In the example of the first connector 10, as illustrated in FIG. 9A, the supported part 35 of the lever 30 has a corner part 35*a* on one part of an outer circumference surface thereof. A distance from the rocking center C1 to the corner part 35*a* is greater than a distance from the rocking center C1 to a circular part 35*b*. When the lever 30 is in the lever releasing position, a straight line L1 tying the rocking center C1 to the corner part 35*a* is inclined significantly with respect to a horizontal surface P1 (the horizontal surface P1 is a plane that is orthogonal to the upward and downward direction passing through the rotating center C1). As illustrated in FIG. 9B, an angle between the straight line L1 and the horizontal surface P1 becomes smaller when the lever 30 moves from the lever releasing position to the lever engaging position. That is, the straight line L1 approaches horizontal. Furthermore, the corner part 35*a* hits a support surface 24*a* formed on the inside of the support part 24 (concave part) of the wall part 22A (the support surface 24*a* is a surface that faces the mating area A). As a result, the position of the supported part 35 (that is, the position of the lever 30) approaches the mating area A when the lever 30 rotates from the lever releasing position toward the lever engaging position. Doing this allows the lever 30 and the second connector 70 to be used more reliably.

The structures of the supported part 35 and the support part 24 are not limited to those in the example of the first connector 10. For example, the support surface 24*a* of the support part 24 may be curved toward the inside of the support part 24. In yet another example, the supported part 35 and the support part 24 need not be formed so as to move the position of the lever 30 toward the mating area A.

Retainer

As illustrated in FIG. 2, the first connector 10 may have a retainer 13 attached to the wall part 22A of the first housing 21. Furthermore, the retainer 13 may keep the supported part 35 of the lever 30 from moving upward (out of the support part 24). The retainer 13 is, for example, a U-shaped member that opens downward, and is attached to the wall part 22A so as to cover the inner surface, upper surface, and outer surface of the wall part 22A of the first housing 21. That is, the retainer 13 has an inner part 13*e* positioned on the inner surface of the wall part 22A, and an outer part 13*f* positioned on the outer surface of the wall part 22A. The retainer 13 also has a stopper part 13*a* positioned above the supported part 35 of the lever 30. As was described above, in the example of the first connector 10, two of the levers 30 are provided on mutually opposite sides sandwiching the mating area A. The retainer 13 is provided for the supported part 35 of each of the levers 30. That is, in the example of the first connector 10, four of the retainers 13 are attached to the first housing 21. The retainer 13 is formed of, for example, a metal.

As illustrated in FIG. 2, the retainer 13 has a contact part 13*b* positioned in the mating area A. Meanwhile, as illustrated in FIG. 5, the second connector 70 has a terminal 73 aligned along with the second terminal 72 in the leftward and rightward direction. The terminal 73 is provided in a position corresponding to the contact part 13*b* of the retainer 13, and makes contact with the contact part 13*b* of the retainer in a state where the connectors 10 and 70 are mated. Using this structure, the retainer 13 for preventing the lever 30 from coming out can be used to make an electrical connection between the second connector 70 and the terminal 73. As a result, the first connector 10 can have fewer parts. The retainer 13 also has a connecting part 13C (see FIG. 7) soldered to the circuit board El. The connecting part 13*c* is formed, for example, on a lower end of the inner part 13*e* of the retainer 13. The connecting part 13*e* may be formed on a lower end of the outer part 13*f* of the retainer 13.

Like the second terminal 72, the terminal 73 also has an outer contact part 73*b* (see FIG. 5) provided on the outer surface of the wall part 82A. In a state where the connectors 10 and 70 are mated to one another, the contact part 13*b* of the retainer 13 makes contact with the outer contact part 73*b* of the terminal 73. In order to create contact pressure between the contact part 13*b* and the terminal 73, the contact part 13*b* may be formed so as to be elastically deformable. The terminal 73 may have a connecting part 73*c* extending from an upward end of the outer contact part 73*b*. When the second connector 70 is used, the connecting part 73*c* of the terminal 73 is connected to a plurality of conductor parts formed in the circuit board E2. In the example of the second connector 70, two of the terminals 73 are provided in each of the wall parts 82A, and the second terminal 72 is provided therebetween.

Position of Operating Part and Height of Outer Peripheral Wall Part

When the regulating part 33 of the lever 30 is provided in the regulating position, that is, when the lever 30 is provided in the lever engaging position, part of the operating part 32 may exceed the height of the outer peripheral wall part 22 of the first housing 21 in the upward direction. That is, as illustrated in FIG. 7, when the lever 30 is provided in the lever engaging position, part of the operating part 32 may exceed a horizontal surface P3 in the upward direction (the horizontal surface P3 a plane that passes through the upper edge of the outer peripheral wall part 22 and is orthogonal to the upward to downward direction). Using this structure makes it possible for an operator to determine whether the regulating part 33 is properly engaging the second connector 70 based on relative positions of the upper edges of the operating part 32 and the outer peripheral wall part 22. As illustrated in FIG. 7, when the lever 30 is in the lever engaging position, an upper surface 32*c* of the operating part 32 may be provided substantially parallel to the horizontal surface P3. This makes it easier for the operator to press the upper surface 32*c* of the operating part 32 downward.

The height of the upper edge of the outer peripheral wall part 22 varies based on the position of said part. For example, the height of a part where the first terminal 12 is attached may greater than the height of a part surrounding the lever 30 (the part surrounding the lever 30 is a part that overlaps the lever 30 when seen in the frontward to rearward direction or in the leftward to rightward direction). In this case, the horizontal surface P3 may be a horizontal surface passing through the upper edge of the part surrounding the lever 30.

As was described above, in the example of the first connector 10, the retainer 13 is attached to the wall part 22A of the first housing 21. As illustrated in FIG. 9B, when the lever 30 is in the lever engaging position, a part of the operating part 32 may exceed an upper edge 13*g* of the retainer 13 in the upward direction.

As described above, the first connector 10 has the rockable lever 30 for engaging with a second connector. The lever 30 has the first working part 31, the operating part 32, and the regulating part 33. The first working part 31 is positioned in the mating area A where the second connector 70 is provided, and is positioned downward with respect to the second connector 70. The operating part 32 is positioned outside the mating area A and can move in the upward to downward direction due to the rocking of the lever 30. The operating part 32 is positioned on a side opposite the first working part 31 sandwiching the rocking center C1, and the operating part 32 and the first working part 31 move in mutually opposite directions. Due to the rocking of the lever 30, the regulating part 33 can move between a regulating position (FIG. 6B) and the allowing position (FIG. 6A).

The present disclosure is not limited to the embodiments described above. It is obvious to a person skilled in the art that there are other embodiments able to achieve the same functions and results. Other such practically equivalent embodiments are covered by the scope of patent claims.

The invention claimed is:

1. A connector assembly comprising:

a first connector; and a second connector that mates to the first connector in a first direction, wherein the first connector includes a rockable lever for engaging with the second connector, the lever including:

a working part, the working part being positioned in the first direction with respect to the second connector, the working part being movable in the first direction and in a second direction through the rocking of the lever, the second direction being opposite the first direction;

an operating part, the operating part being positioned on an outside in a third direction with respect to the second connector, the third direction intersecting the first and second directions, the operating part being movable in the first and second directions through the rocking of the lever, the operating part being positioned on a side opposite the working part sandwiching a rocking center of the lever, the operating part being movable in a direction opposite that of the working part; and a regulating part, the regulating part being movable between a regulating position for regulating the movement of the second connector in the second direction and an allowing position for allowing the movement of the second connector in the second direction, the regulating position being where the regulating part is positioned in the second direction with respect to part of the second connector and the allowing position being where the regulating part is positioned separated from the part of the second connector, wherein the lever is movable between a lever engaging position where the regulating part is provided in the regulating position and a lever releasing position where the regulating part is provided in the allowing position, wherein the lever moves from the lever releasing position to the lever engaging position when the working part moves in the first direction, and wherein the lever moves from the lever engaging position to the lever releasing position when the working part moves in the second direction, and wherein the first connector has a housing having an outer peripheral wall part able to provide the second connector on an inside of the housing, the outer peripheral wall part having first and second side wall parts and a first end wall part which connects first end parts of the first and second side wall parts, and wherein each of the working part, the operating part and the regulating part of the lever are provided on an inside of the outer peripheral wall part, and wherein the lever is rockably supported by the first and second side wall parts of the outer peripheral wall part.

2. The connector assembly according to claim 1, wherein the regulating part is positioned between the working part and the operating part when viewing the first connector in the first direction, and the regulating part is positioned farther in the second direction than the rocking center of the lever when viewing the first connector in a direction along a straight line passing through the rocking center of the lever.

3. The connector assembly according to claim 1, wherein the regulating part is provided with an end part that protrudes in the first direction when in the lever engaging position, and the second connector is provided with a corner part that protrudes in the second direction so as to face the end part.

4. The connector assembly according to claim 1, wherein the lever is provided in the lever releasing position under the lever's own weight in a state where the second connector is not mated with the first connector.

5. The connector assembly according to claim 1, wherein at least part of the operating part exceeds a height of the outer peripheral wall part in the second direction when the regulating part is provided in the regulating position.

6. The connector assembly according to claim 1, wherein the working part extends toward the second connector from a base part thereof, the base part of the working part being positioned close to the rocking center of the lever, the regulating part extends toward the second connector from a base part thereof, the base part of the regulating part being positioned close to the rocking center of the lever, the working part and the regulating part are separated in the first and second directions, and the lever has a reinforcing wall part by which the regulating part and the working part are connected.

7. The connector assembly according to claim 6, wherein the lever has two reinforcing wall parts separated in a direction along a straight line passing through the rocking center of the lever as the aforementioned reinforcing wall, and the working part and the regulating part of the lever are formed between the two reinforcing wall parts.

8. The connector assembly according to claim 1, wherein the first connector has a first lever and a second lever mutually separated from one another.

9. The connector assembly according to claim 8, wherein the outer peripheral wall part has a second end wall part which connects second end parts of the first and second side wall parts, the first lever being positioned proximate to the first end wall part, the second lever being positioned proximate to the second end wall part.

10. A connector comprising:

a housing having an outer peripheral wall part able to provide a counterpart connector on an inside of the housing, the outer peripheral wall part having first and second side wall parts and a first end wall part which connects first end parts of the first and second side wall parts; and a rockable lever provided on an inside of the outer peripheral wall part, the rockable lever being supported by the outer peripheral wall part, the rockable lever being configured to engage a counterpart connector, the lever comprising:

a working part, the working part being configured to move in first and second directions through the rocking of the lever, the second direction being opposite the first direction;

an operating part, the operating part being positioned on an outside in a third direction, the third direction intersecting the first direction and the second direction, the operating part being configured to move in the first and second directions through the rocking of the lever, the operating part being positioned on a side opposite the working part sandwiching a rocking center of the lever, the operating part being configured to move in a direction opposite that of the working part; and a regulating part, the regulating part being configured to move between a regulating position for regulating movement of the counterpart connector in the second direction and an allowing position for allowing movement of the counterpart connector in the second direction, wherein the lever is configured to move between a lever engaging position where the regulating part is provided in the regulating position and a lever releasing position where the regulating part is provided in the allowing position, wherein the lever is configured to move from the lever releasing position to the lever engaging position when the working part moves in the first direction, and wherein the lever is configured to move from the lever engaging position to the lever releasing position when the working part moves in the second direction, and wherein each of the working part, the operating part and the regulating part of the lever are provided on an inside of the outer peripheral wall part, and wherein the lever is rockably supported by the first and second side wall parts of the outer peripheral wall part.

11. The connector according to claim 10, wherein the regulating part is provided with an end part that protrudes in the first direction when in the lever engaging position.

12. The connector according to claim 10, wherein the lever is provided in the lever releasing position under the lever's own weight in a non-mating state.

13. The connector assembly according to claim 10, wherein at least part of the operating part exceeds a height of the outer peripheral wall part in the second direction when the regulating part is provided in the regulating position.

14. The connector according to claim 10, wherein the connector has a first lever and a second lever mutually separated from one another.

15. The connector according to claim 10, wherein the working part extends from a base part thereof, the base part of the working part is positioned close to the rocking center of the lever, the regulating part extends from a base part thereof, the base part of the regulating part is positioned close to the rocking center of the lever, the working part and the regulating part are separated in the first and second directions, and the lever has a reinforcing wall part by which the regulating part and the working part are connected.

16. The connector according to claim 15, wherein the lever has two reinforcing wall parts separated in a direction along a straight line passing through the rocking center of the lever as the aforementioned reinforcing wall, and the working part and the regulating part of the lever are formed between the two reinforcing wall parts.

17. The connector according to claim 10, wherein the regulating part is positioned between the working part and the operating part when viewing the connector in the first direction, and the regulating part is positioned farther in the second direction than the rocking center of the lever when viewing the connector in a direction along a straight line passing through the rocking center of the lever.

18. The connector according to claim 17, wherein the outer peripheral wall part has a second end wall part which connects second end parts of the first and second side wall parts, the first lever being positioned proximate to the first end wall part, the second lever being positioned proximate to the second end wall part.

* * * * *